US005901796A

United States Patent [19]

McDonald

[11] Patent Number: 5,901,796

[45] Date of Patent: May 11, 1999

[54] CIRCULATING SUB APPARATUS

[75] Inventor: Andrew McDonald, Montrose, United Kingdom

[73] Assignee: Specialty Tools Limited, Aberdeen, United Kingdom

[21] Appl. No.: 08/794,610

[22] Filed: Feb. 3, 1997

[51] Int. Cl.[6] ..... E21B 21/10; E21B 34/10

[52] U.S. Cl. ..... 175/57; 175/317; 175/324; 166/321; 166/331

[58] Field of Search ..... 166/319, 321, 166/240, 331; 175/317, 324, 57

[56] References Cited

U.S. PATENT DOCUMENTS

| | | | |
|---|---|---|---|
| 4,113,012 | 9/1978 | Evans et al. | 166/321 |
| 4,298,077 | 11/1981 | Emery . | |
| 4,343,370 | 8/1982 | Chatard et al. | 166/319 |
| 4,403,659 | 9/1983 | Upchurch | 166/374 |
| 4,718,494 | 1/1988 | Meek | 166/319 |
| 4,749,044 | 6/1988 | Skipper et al. | 166/323 |
| 5,222,559 | 6/1993 | Edwards et al. | 166/321 |
| 5,443,129 | 8/1995 | Bailey et al. . | |
| 5,609,178 | 3/1997 | Henning et al. | 166/319 |

FOREIGN PATENT DOCUMENTS

| | | |
|---|---|---|
| 2054008 | 11/1981 | United Kingdom . |
| 96/30621 | 3/1996 | WIPO . |

*Primary Examiner*—Hoang G. Dang
*Attorney, Agent, or Firm*—Ratner & Prestia

[57] ABSTRACT

There is provided a circulating sub apparatus (50) having a tubular outer body member (51, 53, 54, 55, 56, 57) and a tubular inner body member (52, 65). The outer body member (51, 53, 54, 55, 56, 57) and the inner body member (52, 65) each have one or more holes (66, 68) substantially transverse to the longitudinal axis of the outer (51, 53, 54, 55, 56, 57) and inner (52, 65) body members. A displacement mechanism produces relative movement between the outer (51, 53, 54, 55, 56, 57) and inner (52, 65) body members such that the outer (51, 53, 54, 55, 56, 57) and inner (52, 65) body members may be repeatably moved between an aligned position, in which the one or more holes (66, 68) on the inner body member (52, 65) are aligned with the one or more holes (66, 68) on the outer body member (51, 53, 54, 55, 56, 57), and an obturated position, in which the one or more holes (66, 68) on the inner body member (52, 65) are obturated by the outer body member (51, 53, 54, 55, 56, 57).

23 Claims, 7 Drawing Sheets

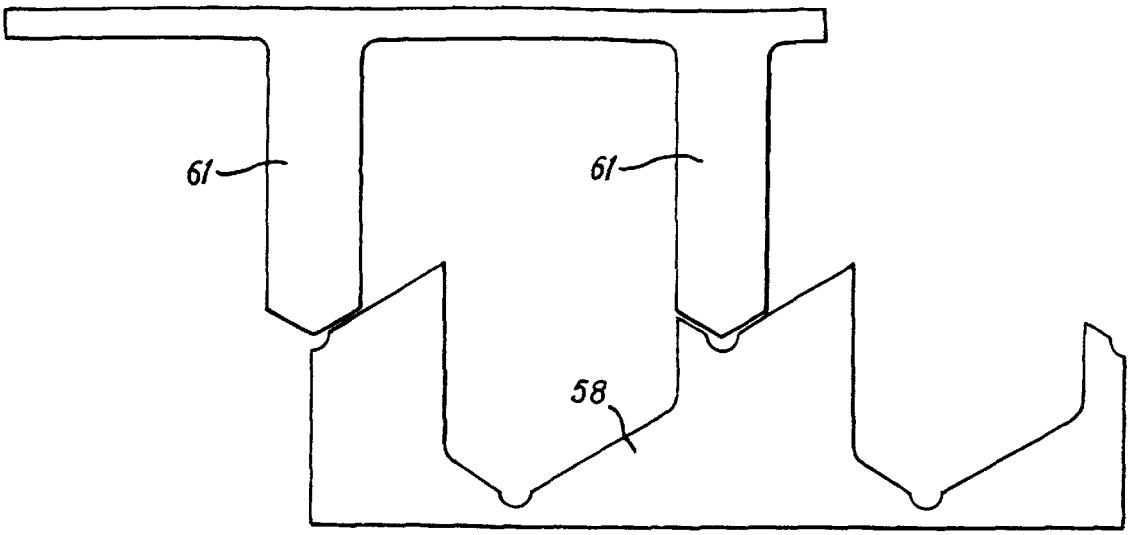
FIG. 5a
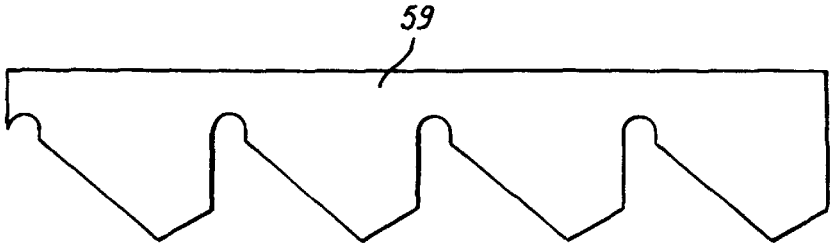
FIG. 5b
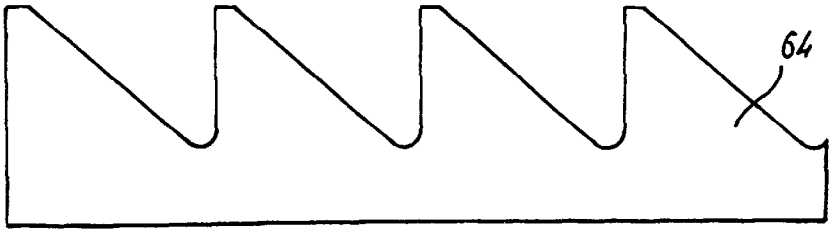

CIRCULATING SUB APPARATUS

This invention relates to a circulating sub, and more particularly to a multi-opening circulating sub for use in energy exploration, milling and drilling.

BACKGROUND OF THE INVENTION

Conventional oil and gas drilling techniques utilise drill-bits which are conveyed on individual lengths (usually 30 feet) of drill-pipe and rotated from the surface of the drilling rig floor to produce the necessary rotary cutting action required to drill well bores. Alternatively, the rotary cutting action can be supplied by using a Positive Displacement Motor (PDM) located above the drill-bit and connected to the surface by either coil tubing that is provided in one continuous length, or by more conventional drill-pipe. The PDM produces the rotary action when drilling fluid is pumped through it from the surface. The main advantage of using coil tubing in conjunction with a PDM is that of a decrease in the running-in time of the equipment into the well-bore.

Debris or cuttings are produced from the cutting action, which are transported to the top of the well bore by the drilling fluid. In order to clean the well bore effectively the drilling fluid must be pumped at a high enough flow rate to lift the cuttings to the surface. However, only relatively low volumes of drilling fluid can be pumped through the complete Bottom Hole Assembly (BHA) without a large pressure drop at the surface.

This problem can be alleviated by using nitrogen to clean the well-bore which gives increased hole cleaning capabilities.

However, the use of nitrogen gives rise to a second problem, in that, nitrogen can only be pumped through a PDM motor for very short periods of time without damaging the PDM motor. Hence, the benefits of using nitrogen to clean the well-bore with existing technology are limited.

Traditionally, this first problem is overcome by using an additional tool in conjunction with the motor and drilling/milling assembly, known as a drop-ball circulating sub. This tool is run above the motor and is operated by dropping a ball, from the surface, down the drill-pipe or coil tubing. The ball seats on top of a piston within the tool and pressure is applied to the upper end of the piston and ball. The pressure is increased until shear pins, which are located within the main body of the drop-ball circulating sub, break allowing the piston to move axially downwards within the main body thereby uncovering circulating holes in the main body drilled transverse to the centre-line of the drop-ball circulating sub. These holes allow an increased flow rate to be pumped through the drill-pipe or coil tubing, thus giving a more effective hole cleaning capability.

However, this tool has the disadvantage that once the ball has been dropped to the circulating sub, no further milling or drilling can take place as the fluid path to the PDM has been blocked by the ball. If further milling or drilling is required then the tool must be removed from the well-bore so that the ball can be removed. Also, the length of time that the ball takes to drop down the drill-pipe or coil tubing can be considerable.

The second problem of pumping nitrogen is helped, but not solved, by using a drop-ball circulating sub as the drop-ball does not effect a complete seal on the piston allowing nitrogen to flow through the motor.

SUMMARY OF THE INVENTION

According to a first aspect of the present invention, there is provided a circulating sub apparatus having a tubular outer body member and a tubular inner body member, the outer body member and the inner body member each having one or more holes, the holes being substantially transverse to the longitudinal axis of the outer body member and the inner body member, and a displacement mechanism for producing relative movement between the outer body member and the inner body member, such that the inner body member and the outer body member may be repeatably moved between an aligned position, in which the one or more holes on the inner body member are aligned with the one or more holes on the outer body member, and an obturated position, in which the one or more holes on the inner body member are obturated by the outer body member.

Preferably, when the outer body member and the inner body member are positioned relative to one another in the obturated position, fluid can pass from the inner bore of the outer body member to the inner bore of the inner body member and out of the bottom end of the inner body member.

Preferably, when the outer body member and the inner body member are positioned relative to one another in the aligned position, a bypass passage is formed that allows fluid to flow from the internal bore of the circulating sub apparatus to the annulus between the outside diameter of the tool and the inside diameter of the well bore, in use.

Preferably, the displacement mechanism is controlled by fluid pressure. Preferably, the displacement mechanism comprises a piston assembly and a restrictor nozzle in the fluid path.

The displacement mechanism typically includes a restraining device.

Preferably the restrictor nozzle is located on the uppermost portion of the inner body member such that fluid passing through the inner bore of the circulating sub apparatus passes through the restrictor nozzle.

Typically, the piston assembly is coupled to the inner body member.

Typically, an increase in the fluid pressure displaces the inner body member in a downwards direction.

Typically, there is provided a return spring, one end of which butts against the outer body member and the other end butts against the inner body member.

Typically, the restraining device comprises at least one restraining member mounted on each of the inner and outer body members, the restraining member(s) mounted on the inner body member being selectively co-operable with the corresponding restraining member(s) mounted on the outer body member.

Preferably, there are two restraining members mounted on each of the inner and outer body members.

Preferably, the two restraining members mounted on one of the body members are spaced further apart than the two restraining members mounted on the other of the body members. More preferably, it is the two restraining members mounted on the inner body member that are spaced further apart than the two restraining members mounted on the outer body member.

Typically, the two restraining members mounted on the inner body member are mounted on the piston assembly.

Typically, longitudinal movement of the inner body member with respect to the outer body member moves one of the restraining members mounted on the inner body member into contact with the corresponding restraining member mounted on the outer body member.

Preferably, one of the restraining members mounted on the inner body member and the corresponding restraining member mounted on the outer body member are adapted to rotate the inner body member with respect to the outer body member, following continued longitudinal movement of the inner body member with respect to the outer body member.

Preferably, after a predetermined longitudinal movement of the inner body member, the restraining members in contact on the inner and outer body members are adapted to restrain the inner body member in a first position from further rotation.

Preferably, longitudinal movement in the opposite direction moves the other of the restraining members mounted on the inner body member into contact with the corresponding restraining member mounted in the outer body member.

Typically, the other of the restraining members mounted on the inner body member and the corresponding restraining member mounted on the outer body member are adapted to rotate the inner body member with respect to the outer body member, following continued longitudinal movement of the inner body member in the opposite direction with respect to the outer body member.

Typically, a second restrained position is reached upon longitudinal movement in the opposite direction to the direction of longitudinal movement for which the first restrained position was reached.

Typically, the direction of rotation of the inner body member with respect to the outer body member for which the first restrained position is reached is the same direction of rotation for which the second restrained position is reached.

Preferably, the first position is the aligned position and the second position is the obturated position.

Alternatively, the first position is the obturated position and the second position is the aligned position.

Preferably, when the circulating sub is in the aligned position, a sealing device deters the flow of fluid through the bottom end of the circulating sub, and more preferably deters the flow of fluid through the bottom end of the inner body member.

Typically, when the circulating sub is in the aligned position, the sealing device seals the bottom end of the inner body member.

The invention has the advantage that nitrogen gas may be pumped through the circulating sub and through the circulating holes, when the circulating sub is in the aligned position, to clean the well bore without damaging any tools located below the circulating sub.

According to a second aspect of the present invention there is provided a method of drilling or milling in a borehole, the method comprising (a) inserting in the borehole a drill string which includes a drill or mill and a circulating sub according to the first aspect, (b) altering the flow rate of fluid to move the body members to the obturated position to permit drilling or milling, (c) altering the flow rate of fluid to move the body members to the aligned position to permit circulation, and (d) repeating steps (b) and (c) as required.

Preferably, the drill string also includes a fluid operated motor, such as a positive displacement motor, and/or a reamer.

The fluid may be a liquid or a gas and is preferably a drilling fluid. Alternatively, or in addition the fluid may be nitrogen gas.

BRIEF DESCRIPTION OF THE DRAWINGS

An embodiment of the invention will now be described, by way of example, with reference to the accompanying drawings wherein:

FIGS. 5 (*a*) and (*b*) show the restraint devices of FIGS. 2 (*a*) and (*b*) during a circulating operation;

DESCRIPTION OF A PREFERRED EMBODIMENT

Figure 1:
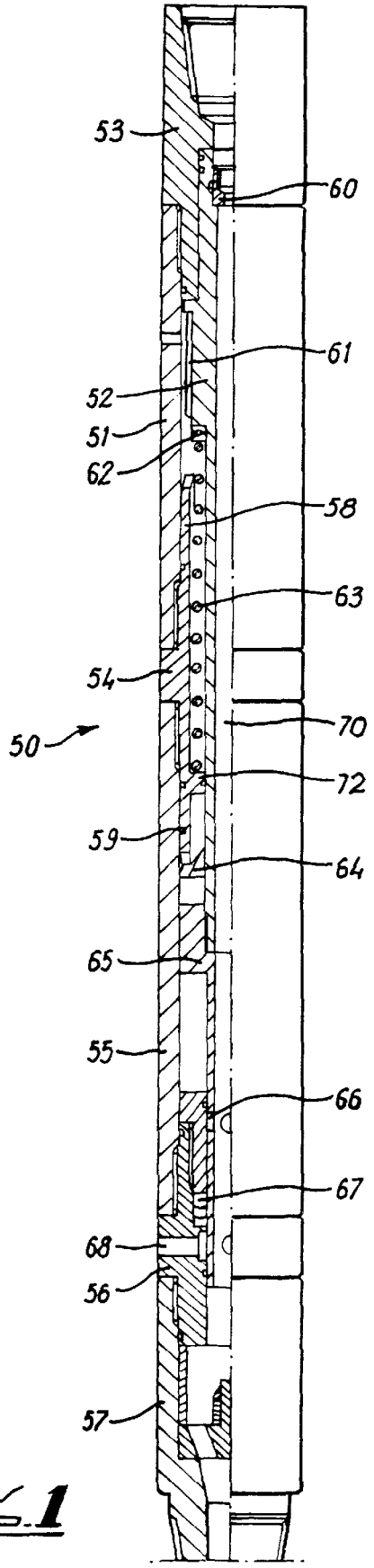
FIG. 1 is a split sectional view of a circulating sub during a milling/drilling operation.

FIG. 1 shows an example of a multi-opening circulating sub 50 in accordance with the present invention, consisting of an outer tubular body formed by a number of outer body sections 51, 53, 54, 55, 56 and 57, and an inner tubular body comprising an upper piston 52 and a lower piston 65. The upper piston 52 is coupled at its lower end to the lower piston 65. The upper end of the upper piston 52 is coupled to a restrictor nozzle 60.

For a milling or drilling operation, drilling fluid flows from a coiled tubing that is connected to an upper outer body section 53, through the restrictor nozzle 60, through a bore 70 of the circulating sub 50, out of the lower outer body section 57 and subsequently onwards to equipment located below the circulating sub 50, such as a PDM.

To obtain a circulating operation, the fluid flow rate through the circulation sub 50 is increased. This increased fluid flow rate through the restrictor nozzle 60 creates a back pressure of drilling fluid across the restrictor nozzle 60, which forces the piston assembly 52, 65 longitudinally downwards within the outer body sections 51, 53, 54, 55, 56.

As the piston assembly 52, 65 moves longitudinally downwards, mating angles 61 mounted on the upper piston 52 contact an upper clutch 58 which is mounted to an outer body section 54, the contact rotating the piston assembly 52, 65 within the outer body sections 51, 53, 54, 55, 56.

The upper clutch 58 is formed to have two restraint positions. The first restraint position allows the piston assembly 52, 65 to only travel a short distance, so that the drilling fluid continues to flow through the circulating sub 50 and onto equipment located below.

The second restraint position allows the piston assembly 52, 65 to travel a greater distance, so that bypass ports 66 located on the lower piston 65 move into alignment with circulating holes 68 located on an outer body section 56. Drilling fluid will now flow down the bore 70 of the circulating sub 50 and out of the circulating holes 68 via the bypass ports 66. A pack-off sealing element 69 prevents any drilling fluid from flowing through the lowest outer body section 57 and on towards equipment located below. The operation of the pack-off sealing element 69 will be described subsequently.

Once the circulating sub 50 has been operated for the required period in one of the restrained positions, that is either in the drilling mode or the circulating mode, to change to the other operating mode, the drilling fluid flow rate is reduced. This action reduces the drilling fluid back pressure across the restrictor nozzle 60. A return spring 63 which acts between a shoulder 72 mounted on the outer body section 54 and a thrust bearing 62 mounted on the upper piston 52, biasses the upper piston 52 upwards, and when the drilling fluid flow rate is reduced the piston assembly 52 moves upward.

The thrust bearing 62 ensures that any residual torque retained in the return spring 63 is dissipated, and hence does not interfere with the rotation of the piston assembly 52, 65.

As the piston assembly 52, 65 moves upward, an indexer 64 mounted on the lower piston 65 contacts a lower clutch 59 which is mounted to the outer body section 54. The contact between the indexer 64 and the lower clutch rotates the piston assembly 52, 65 in the same direction as the rotation produced by the upper clutch 58 and the mating angles 61 on a downward movement. Through this rotation as the piston assembly travels upwards, it will have moved onto it's next restrained position and hence it's next mode of operation.

Figure 2A:
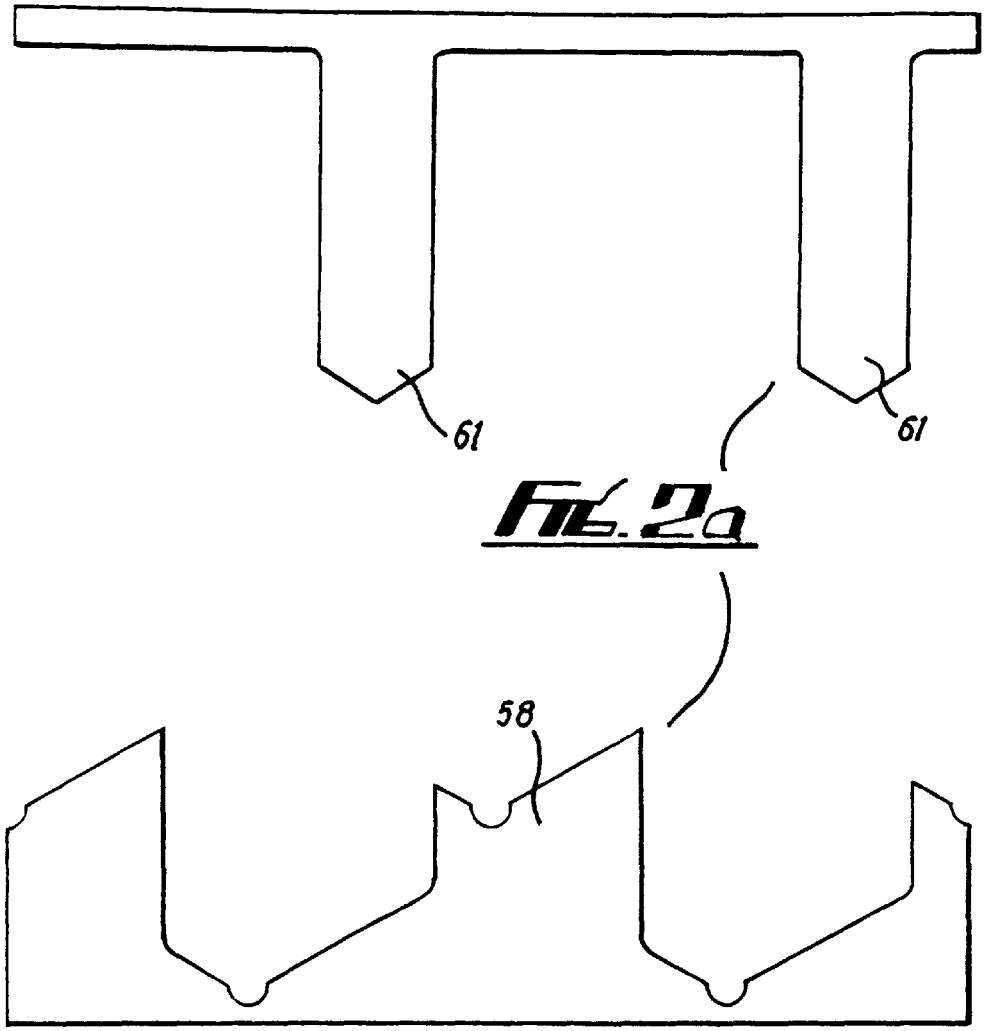
FIGS. 2 (*a*) and (*b*) are schematic drawings of the positional relationship between restraint devices mounted on the circulating sub of FIG. 1.
Figure 2B:
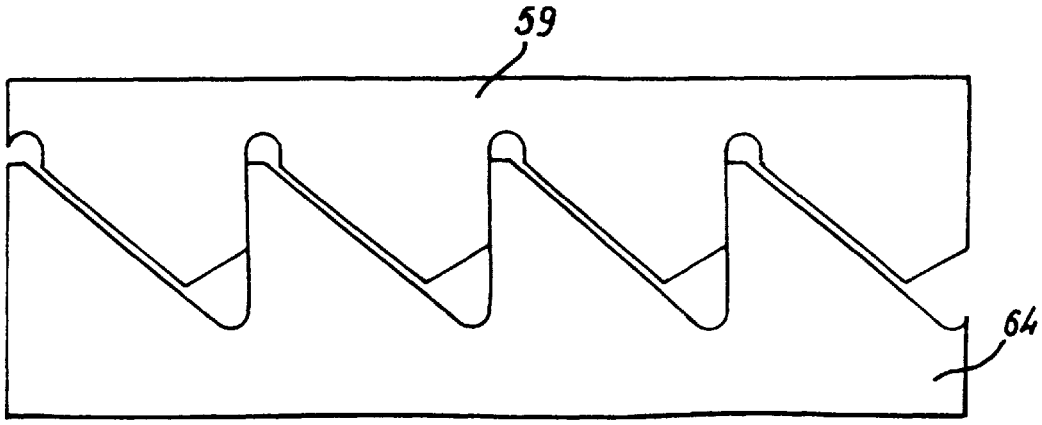

FIGS. 2 (*a*) and (*b*), 3 (*a*) and (*b*), 4 (*a*) and (*b*) and 5 (*a*) and (*b*) shows the positional relationship between firstly the lower clutch 59 and the indexer 64, and secondly the upper clutch 58 and the mating angles 61, for a complete cycle of the circulating sub 50, with the components being shown laid out flat for clarity.

FIG. 2 (*b*) shows the indexer 64 and the lower clutch 59 in an engaged position, and FIG. 2 (*a*) shows the mating angles 61 longitudinally displaced from the upper clutch 58. FIGS. 2 (*a*) and (*b*) show the piston assembly 52, 65 in the position as shown in FIG. 1.

Figure 3A:
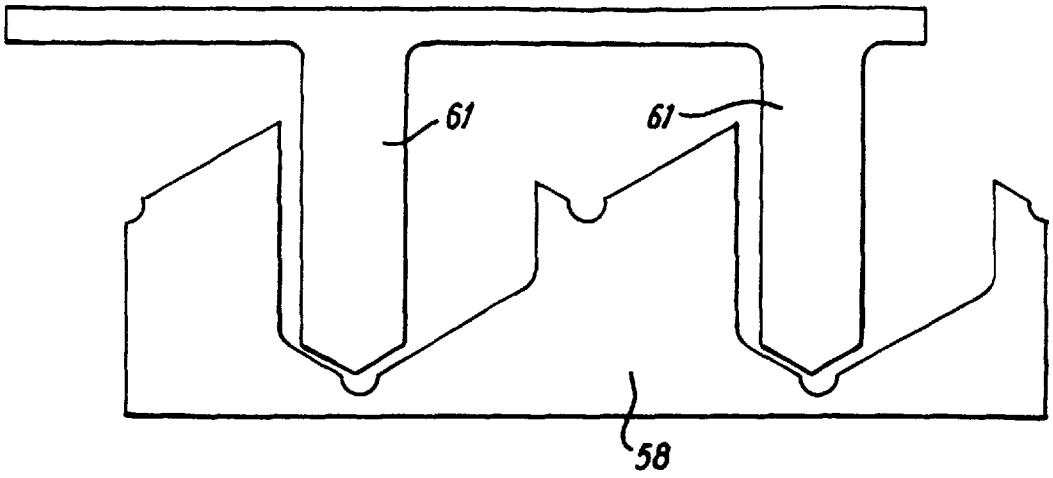
FIGS. 3 (*a*) and (*b*) show the restraint devices of FIGS. 2 (*a*) and (*b*) during a milling/drilling operation.
Figure 3B:
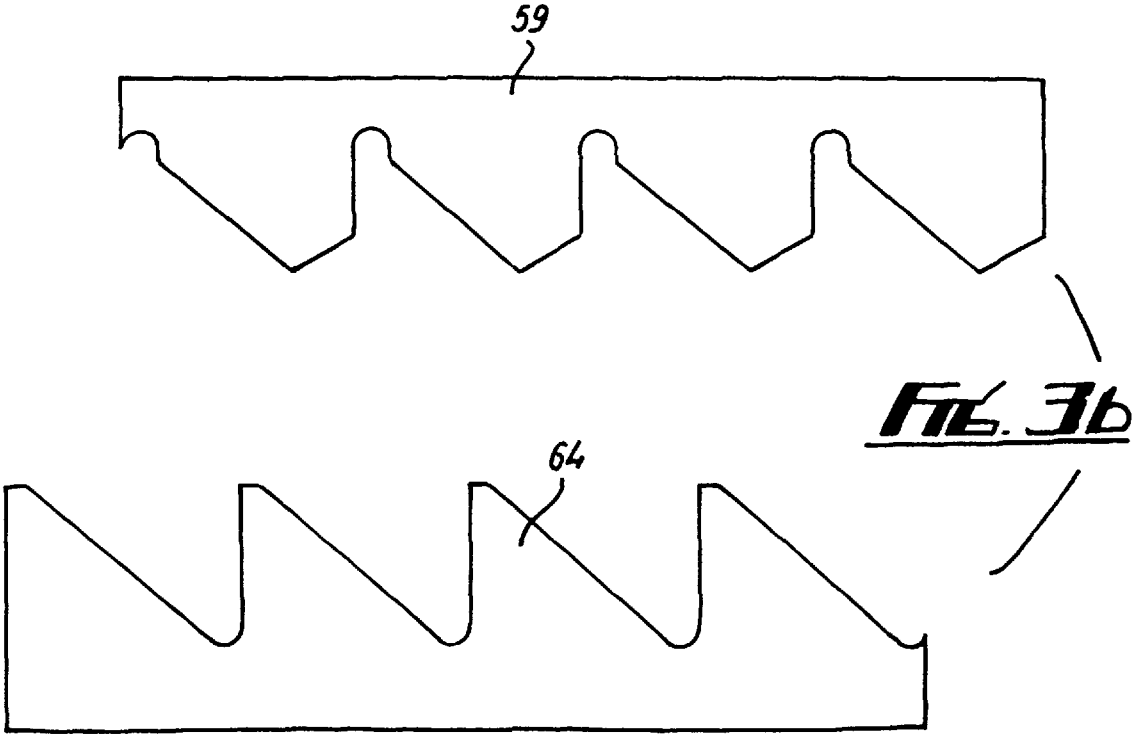

FIG. 3 (*b*) shows that the indexer 64 and the lower clutch 59 have been longitudinally and rotationally displaced, due to downward movement of the piston assembly 52, 65. It can be seen in FIG. 3 (*a*) that the mating angles 61 are in contact with the upper clutch 58, and are restrained in the second, or furthest position possible by the upper clutch 58. This position corresponds to the drilling fluid circulation mode. It can also be seen that the piston assembly rotates in only one direction due to the combination of the profiles of firstly the upper clutch 58 and the mating angles, and secondly the lower clutch 59 and the indexer 64.

Figure 4A:
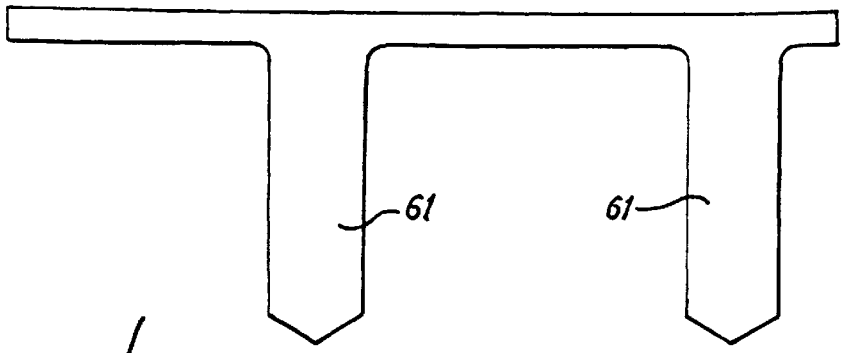
FIGS. 4 (*a*) and (*b*) show the restraint devices of FIGS. 2 (*a*) and (*b*) whilst initiating a circulating operation.
Figure 4B:
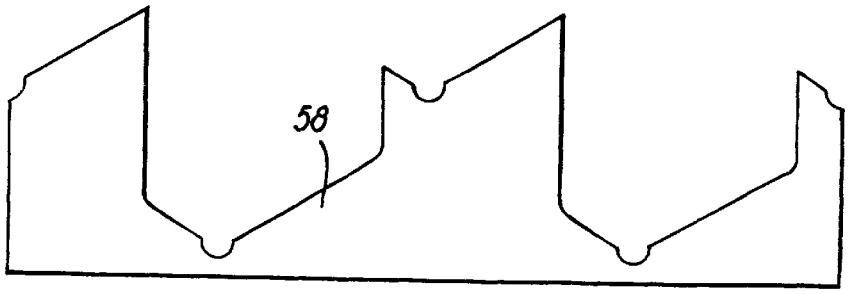
Figure 4B:
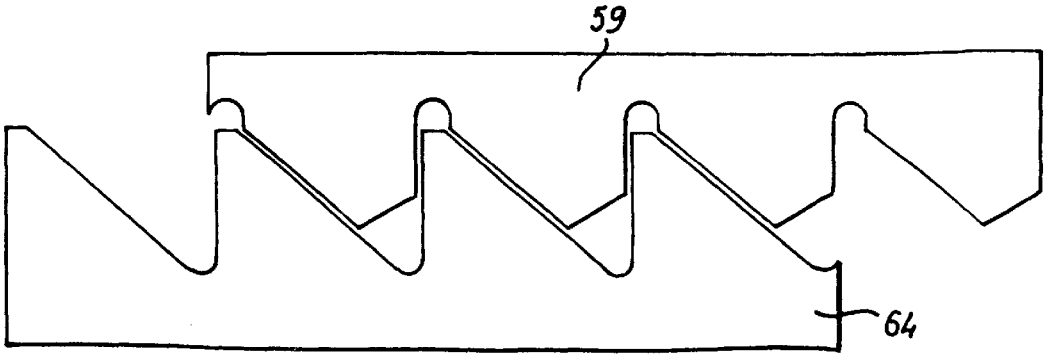

FIGS. 4 (*a*) and (*b*) show that as the back pressure across the restrictor nozzle 60 is reduced, the indexer 64 and the lower clutch 59 come into contact and the piston assembly 52, 65 is further rotated in the same direction as previously. The upper clutch 58 and the mating angles 61 are longitudinally and rotationally spaced once again, and await an increase in the drilling fluid flow rate to enter a drilling fluid flow through cycle.

FIG. 5 (*b*) shows that the lower clutch 59 and the indexer 64 are once again longitudinally and rotationally further displaced, although the longitudinal displacement is not as great as shown in FIG. 3 (*b*). This is due to the mating angles 61 being restrained in the first and least travel position by the upper clutch 58, as shown in FIG. 5 (*a*). This is the drilling fluid flow through mode of operation of the circulating sub 50.

As has previously been described, the circulating sub 50 has two modes of operation, drilling fluid flow through and circulation, for when the piston assembly 52, 65 is restrained in a first and a second position respectively.

Figure 6:
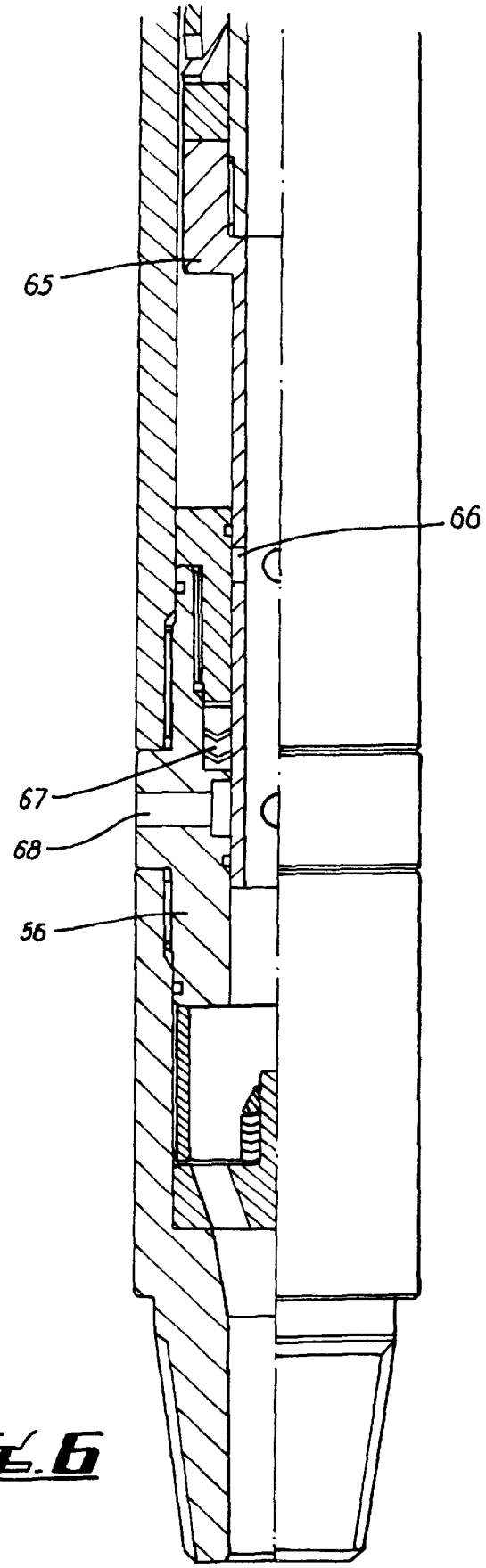
FIG. 6 is a detailed split sectional view of the lower portion of the circulating sub of FIG. 1 during a milling/drilling operation.

The lower portion of the circulating sub 50 in the first restrained position is shown in detail in FIG. 6. A seal 67 prevents any leakage of drilling fluid between the bypass port 66 and the circulating hole 68, whilst the circulating sub 50 is in the first position, and hence in drilling fluid flow through mode of operation.

Figure 7:
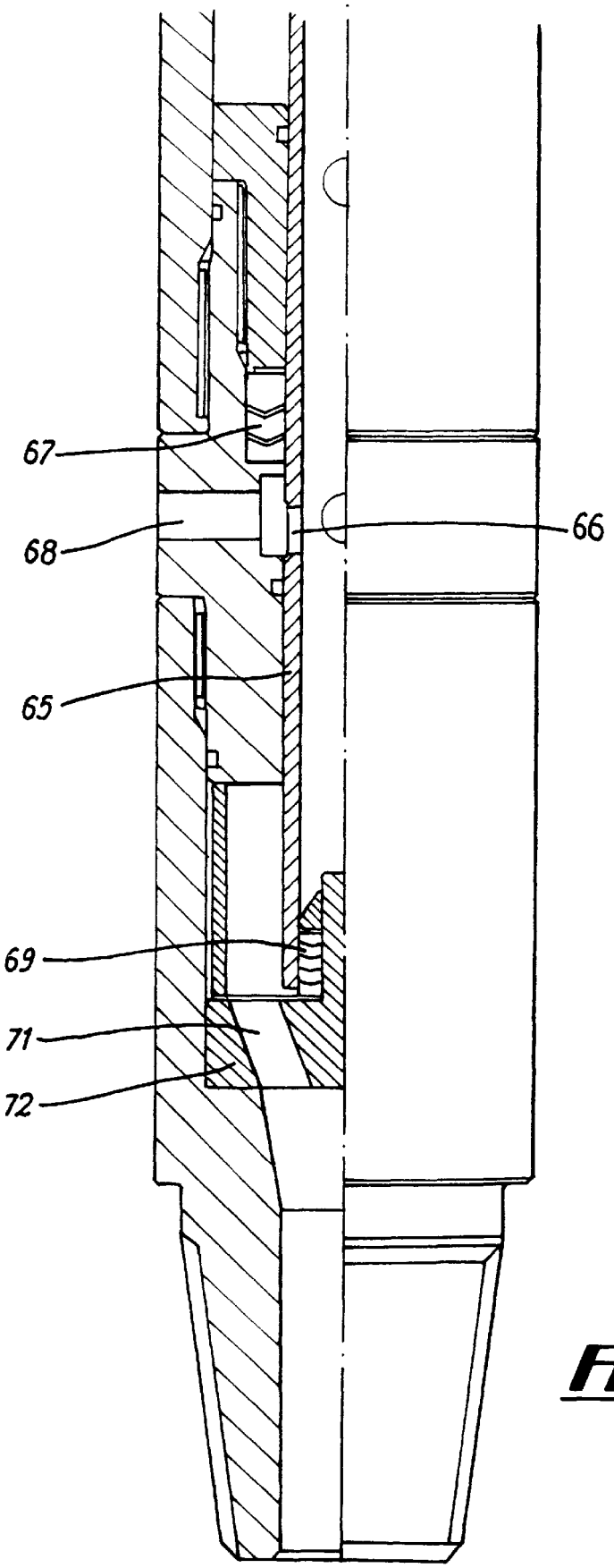
FIG. 7 is a detailed split sectional view of the lower portion of the circulating sub of FIG. 1 during a circulating operation.

The lower portion of the circulating sub 50 in the second restrained position is shown in detail in FIG. 7. The lower piston 65 has moved downwards so that bypass ports 66 are now aligned with the circulating holes 68, thus allowing drilling fluid to exit from the bore 70 of the circulating sub 50 out through the circulating holes 68. When the bypass ports 66 are aligned with the circulating holes 68, the bottom end of the lower piston 65 engages with the pack off sealing element 69 such that no drilling fluid can pass through an aperture 71 in a bottom plug 72 at the bottom end of the circulating sub 50 to the equipment below. Further if nitrogen gas is being circulated through the bore 70 of the circulating sub 50 and out through the circulating holes 68, the seal between the pack off sealing element 69 and the lower piston 65 ensures that no nitrogen gas can pass through any of the tools below the circulating sub 50.

Modifications and improvements can be made to the embodiments, without departing from the scope of the invention.

I claim:

1. A circulating sub apparatus having a throughbore, a tubular outer body member and a tubular inner body member, the outer body member and the inner body member each having one or more holes, the holes being substantially transverse to the longitudinal axis of the outer body member and the inner body member, and a displacement mechanism for producing relative movement between the outer body member and the inner body member, such that the inner body member and the outer body member may be repeatably moved between an aligned position, in which the one or more holes on the inner body member are aligned with the one or more holes on the outer body member, and an obturated position, in which the one or more holes on the inner body member are obturated by the outer body member, and a sealing device which obturates the throughbore when the inner and outer body members are in the aligned position.

2. A circulating sub apparatus according to claim 1, wherein when the outer body member and the inner body member are positioned relative to one another in the obturated position, fluid can pass from the inner bore of the outer body member to the inner bore of the inner body member and out of the bottom end of the inner body member.

3. A circulating sub apparatus according to claim 1, wherein when the outer body member and the inner body member are positioned relative to one another in the aligned position, a bypass passage is formed that allows fluid to flow from the internal bore of the circulating sub apparatus to the annulus between the outside diameter of the circulating sub apparatus and the inside diameter of the well bore, in use.

4. A circulating sub apparatus according to claim 1, wherein the displacement mechanism is controlled by fluid pressure.

5. A circulating sub apparatus according to claim 4, wherein the displacement mechanism comprises a piston assembly and a restrictor nozzle in the fluid path.

6. A circulating sub apparatus according to claim 5, wherein the displacement mechanism further comprises a restraining device.

7. A circulating sub apparatus according to claim 6, wherein the restraining device comprises at least one restraining member mounted on each of the inner and outer body members, the restraining member(s) mounted on the inner body member being selectively co-operable with the corresponding restraining member(s) mounted on the outer body member.

8. A circulating sub apparatus according to claim 7, wherein there are two restraining members mounted on each of the inner and outer body members.

9. A circulating sub apparatus according to claim 8, wherein the two restraining members mounted on the inner body member are spaced further apart than the two restraining members mounted on the outer body member.

10. A circulating sub apparatus according to claim 9, wherein one of the restraining members mounted on the inner body member and the corresponding restraining member mounted on the outer body member are adapted to rotate the inner body member with respect to the outer body member, following continued longitudinal movement of the inner body member with respect to the outer body member.

11. A circulating sub apparatus according to claim 1, wherein the sealing device obturates the throughbore below the one or more holes ot the inner body member when the inner and outer body members are in the aligned position.

12. A circulating sub apparatus according to claim 1, wherein when the circulating sub is in the aligned position, the sealing device deters fluid located within the throughbore from passing below the one or more holes of the inner body member.

13. A circulating sub apparatus according to claim 12, wherein when the circulating sub is in the aligned position, the sealing device deters the flow of fluid through the bottom end of the circulating sub.

14. A circulating sub apparatus according to claim 12, wherein the sealing device deters the flow of fluid through the bottom end of the inner body member.

15. A circulating sub apparatus according to claim 1, wherein the sealing device seals the bottom end of the inner body member.

16. A method of drilling or milling in a borehole, the method comprising:

(a) inserting in the borehole a drill string which includes a drill or mill and a circulating sub, the circulating sub comprising a throughbore, a tubular outer body member and a tubular inner body member, the outer body member and the inner body member each having one or more holes, the holes being substantially transverse to the longitudinal axis of the outer body member and the inner body member, and a displacement mechanism for producing relative movement between the outer body member and the inner body member, such that the inner body member and the outer body member may be repeatably moved between an aligned position, in which the one or more holes on the inner body member are aligned with the one or more holes on the outer body member, and an obturated position, in which the one or more holes on the inner body member are obturated by the outer body member, and a sealing device which obturates the throughbore when the inner and outer body members are in the aligned position;

(b) altering the flow rate of fluid to move the body members to the obturated position to permit drilling or milling;

(c) altering the flow rate of fluid to move the body members to the aligned position to permit circulation; and (d) repeating steps (b) and (c) as required.

17. A method according to claim 16, wherein the sealing device obturates the throughbore below the one or more holes of the inner body member when the inner and outer body members are in the aligned position.

18. A method according to claim 16, wherein when the circulating sub is in the aligned position, the sealing device deters the flow of fluid below the one or more holes of the inner body member.

19. A method according to claim 16, wherein when the circulating sub is in the aligned position, the sealing device deters the flow of fluid through the bottom end of the circulating sub.

20. A method according to claim 16, wherein the sealing device deters the flow of fluid through the bottom end of the inner body member.

21. A method according to claim 16, wherein the sealing device seals the bottom end of the inner body member.

22. A method according to claim 16, wherein the fluid is drilling fluid.

23. A method according to claim 16, wherein the fluid is nitrogen gas.

* * * * *